US005215959A

United States Patent [19]

Van Duzer

[11] Patent Number: 5,215,959

[45] Date of Patent: Jun. 1, 1993

[54] DEVICES COMPRISED OF DISCRETE HIGH-TEMPERATURE SUPERCONDUCTOR CHIPS DISPOSED ON A SURFACE

[75] Inventor: Theodore Van Duzer, El Cerrito, Calif.

[73] Assignee: University of California, Berkeley, Oakland, Calif.

[21] Appl. No.: 885,926

[22] Filed: May 18, 1992

Related U.S. Application Data

[63] Continuation of Ser. No. 586,278, Sep. 21, 1990, abandoned.

[51] Int. Cl.[5] ..... H01P 7/06; H01Q 9/16; H01B 12/06

[52] U.S. Cl. ..... 505/1; 505/700; 505/701; 505/866; 333/99 S; 343/700 R; 343/793

[58] Field of Search ..... 333/99 S; 343/700 R, 343/793, 741; 505/1, 700, 701, 866

[56] References Cited

U.S. PATENT DOCUMENTS

| | | | |
|---|---|---|---|
| 3,184,674 | 5/1965 | Garwin | 333/238 X |
| 3,441,881 | 4/1969 | Weissman | 333/99 S |
| 4,765,055 | 8/1988 | Ozaki et al. | 29/599 |
| 4,837,536 | 6/1989 | Honjo | 333/247 |
| 4,885,494 | 12/1989 | Higashi | 310/211 |
| 4,918,049 | 4/1990 | Cohn et al. | 505/1 |
| 4,918,050 | 4/1990 | Dworsky | 505/1 |

FOREIGN PATENT DOCUMENTS

| | | | |
|---|---|---|---|
| 44104 | 2/1989 | Japan | 333/227 |
| 54740 | 3/1989 | Japan | 505/703 |

OTHER PUBLICATIONS

Walker, G. B. et al; "Superconducting Superdirectional Antenna Arrays"; *IEEE Trans on Antennas & Propagation;* vol. AP-25, No. 6; Nov. 1977; pp. 885-887.

Pavlyuk, V. A., et al; "Superconducting Antenna"; *Sov Tech Phys Lett;* vol. 4, No. 2; Feb. 1978; p. 80.

J. G. Bednorz et al., *Z. Phys.*, B 64, 189 (1986), pp. 189-193.

M. K. Wu et al., *Phys. Rev. Lett.* 908 (1987), pp. 908-910.

"Superconductivity Starts to Go Commercial", *Design News,* May 8, 1989.

S. K. Khamas et al., "A High-Tc Superconducting Short Dipole Antenna", *Electronics Letters,* vol. 24, No. 8, 460-461 (1988).

Z. Wu et al., "Supercooled and Superconducting Small Loop Antenna", *IEEE Colloquium on the Microwave Applications of High Temperature Superconductors,* Oct. 24, 1989.

T. S. M. MacLean et al., "High Temperature Superconducting Antennas", *British Electromagnetic Measurements Conference,* National Physical Laboratory, Nov. 7-9, 1989.

ICI Advanced Materials, "ICI Advanced Materials and AT&T Bell Laboratories High-Temperature Superconductive Resonator", Nov. 3, 1989.

ICI Advanced Materials, "ICI Develops First Superconducting Dipole Antenna", Sep. 26, 1988.

C. E. Gough et al., "Critical Currents in a High-Tc Superconducting Short Dipole Antenna", ACS 1988, San Francisco, Calif.

R. C. Hansen, "Superconducting Antennas", *IEEE Transactions on Aerospace and Electronic Systems,* vol. 26, No. 2, Mar. 1990.

*Primary Examiner*—Robert J. Pascal
*Assistant Examiner*—Benny T. Lee
*Attorney, Agent, or Firm*—Heller, Ehrman, White & McAuliffe

[57] ABSTRACT

A structure having a surface exposed to electromagnetic radiation in the microwave or millimeter-wave spectrum wherein discrete elements including a high-temperature superconducting film formed on a substrate are disposed on the surface.

23 Claims, 2 Drawing Sheets

DEVICES COMPRISED OF DISCRETE HIGH-TEMPERATURE SUPERCONDUCTOR CHIPS DISPOSED ON A SURFACE

This is continuation, of application Ser. No. 07/586,278 filed Sep. 21, 1990, now abandoned.

BACKGROUND OF THE INVENTION

The present invention relates generally to microwave and millimeter-wave devices such as antennas and cavities, and more particularly to microwave and millimeter-wave devices using chips including high-temperature superconducting films.

Conventional, low-temperature superconducting materials have been used to reduce ohmic losses in ultra-high Q cavities at microwave frequencies. Low-temperature superconducting materials, however, possess a number of disadvantages. For example, significant constraints are placed on the operation of such devices due to the requirement to operate at liquid helium temperatures. Additionally, photons in the millimeter-wave/far infrared region may cause transitions across the superconducting energy gap, removing the superconducting properties. There may also be limitations caused by thermal excitations across that gap.

High-temperature superconducting (HTSC) materials have been discovered whose transition to the superconducting state occurs at temperatures above 25 Kelvin (K). These HTSC materials include rare earth elements such as yttrium, lanthanum, and europium combined with barium and copper oxides. An example of such a HTSC material is the Y-Ba-Cu-O system. See J.G. Bednorz et al, *Z. Phys.*, B 64, 189 (1986); and M.K. Wu et al, *Phys. Rev. Lett.* 908 (1987). These materials have critical temperatures of up to approximately 90 K or above.

HTSC ceramics have been used in high frequency cavities and waveguides. See U.S. Pat. No. 4,918,049, the entire disclosure of which is hereby incorporated by reference. Additionally, granular ceramic HTSC materials have been used to make antennas and cavities. See "Superconductivity Starts to Go Commercial", *Design News*, May 8, 1989; S.K. Khamas et al., "A High-$T_c$ Superconducting Short Dipole Antenna", *Electronics Letters*, Vol. 24, No. 8, 460–461 (1988); Z. Wu et al., "Supercooled and Superconducting Small Loop Antenna", *IEEE Colloquium on the Microwave Applications of High Temperature Superconductors*, Oct. 24, 1989; T.S.M. MacLean al., "High Temperature Superconducting Antennas", *British Electromagnetic Measurements Conference*, National Physical Laboratory, Nov. 7–9, 1989; ICI Advanced Materials, "ICI Advanced Materials and AT&T Bell Laboratories High-Temperature Superconductive Resonator", Nov. 3, 1989; ICI Advanced Materials, "ICI Develops First Superconducting Dipole Antenna", Sep. 26, 1988; and C.E. Gough et al., "Critical Currents in a High-Tc Superconducting Short Dipole Antenna", ACS 1988, San Francisco, Calif.

The ceramic HTSC materials used in microwave devices having large areas and complex shapes are of low quality. That is, they have high surface losses. Thin (on the order of 0.50 microns) HTSC films have lower surface losses than ceramic HTSC materials. However, it is improbable that high quality HTSC films can be made for large and/or complex shapes because of the need to match lattice constants with those of the film substrate.

In view of the foregoing, an object of the present invention is to use HTSC thin film chips or discrete elements to make microwave and millimeter-wave devices of larger area and more complex shapes than otherwise possible.

Another object of the present invention is to make use of the low surface resistance of HTSC films in fabricating microwave and millimeter-wave devices.

Yet another object of the present invention is to use high-quality, low-loss HTSC films to cover metal surfaces that would otherwise be exposed to electromagnetic microwave or millimeter-wave fields.

Still another object of the present invention is to use small-area HTSC chips to provide high efficiency microwave and millimeter-wave devices having non-conventional shapes or large-area surfaces.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

SUMMARY OF THE INVENTION

The present invention is directed to a structure exposed to electromagnetic radiation. The structure comprises discrete elements including a substrate on which a high-temperature superconducting film has been formed. The superconducting material has a critical temperature of greater than 25K. The substrate is exposed to the radiation and the elements are electrically interconnected.

The present invention uses chips having high-quality (low-loss) films of a high-temperature superconducting material to make microwave or millimeter-wave devices. The chips are arranged on the surface of the device which would otherwise be exposed to electromagnetic radiation. The substrate side of the chips faces the radiation, and the film side faces the device surface. The chips are connected by metal links to retain most of their advantages properties in the device behavior. The chips reduce the surface resistance ($R_S$) of the normal-conducting surfaces of the device. The chips can be used to make nonplanar shapes such as a cavity and to form large-area planar devices.

BRIEF DESCRIPTION OF THE DRAWINGS

The accompanying drawings, which are in and constitute a part of the specification, schematically illustrate a preferred embodiment of the invention and, together with the general description given above and the detailed description of the preferred embodiment given below, serve to explain the principles of the invention.

DESCRIPTION OF THE PREFERRED EMBODIMENT

The basic concept of the present invention is to use high-quality, low-loss, high-temperature superconducting (HTSC) films to cover metal surfaces of a structure or device which would otherwise be exposed to electromagnetic microwave and/or millimeter-wave fields. This is accomplished by using several or many chips or discrete elements including a film or layer of HTSC material, for example Y-Ba-Cu-O. The HTSC film may be coated with a film or layer of a suitable metal, such as silver or gold. The chips are bonded metal side down to the surface of the structure. The chips may be cut in accurate shapes, for example rectangles or squares, so that when bonded onto the structure surface, they abut each other with a minimum gap.

Figure 1A:
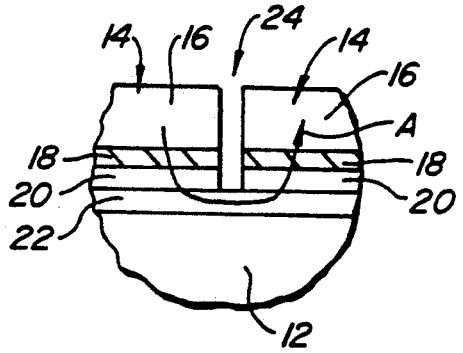
FIG. 1A is a schematic enlarged view of a portion of the structure of FIG. 1.
Figure 1:
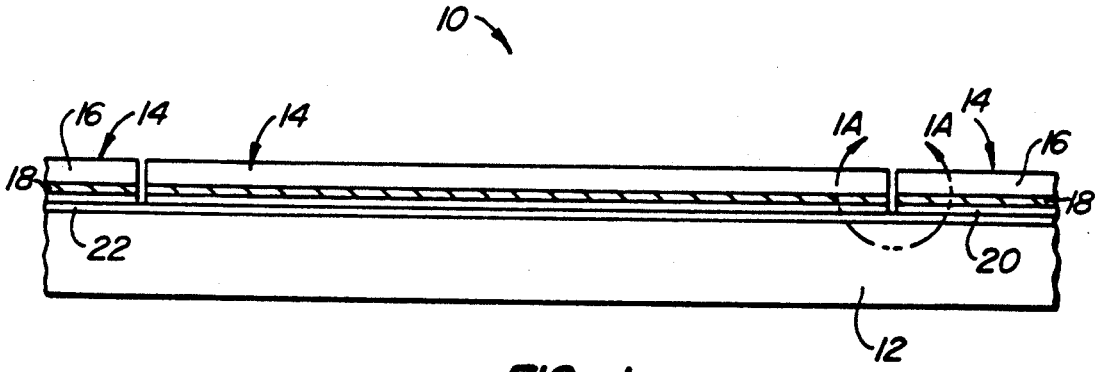
FIG. 1 is a schematic sectional view of a structure in accordance with the present invention.

As shown in FIG. 1, a microwave or millimeter-wave structure 10 in accordance with the present invention includes a normal metallic surface 12, such as copper, on which is disposed a number of HTSC discrete elements or chips 14. The structure 10 may be a device for confining, guiding, receiving, or radiating electromagnetic radiation in the microwave and/or millimeter-wave spectrum. As is known, the microwave and millimeter-wave spectrum includes wavelengths from about 1 to 60 centimeters (cm), corresponding to frequencies from about 0.50 to 300 gigahertz (GHz). The structure may be an antenna, a cavity resonator, a transmission line, or other such device.

Referring back to FIGS. 1 and 1A, the elements or chips 14 comprise a substrate 16 on which has been formed a layer or film 18 of HTSC material. The HTSC film is formed (for example, epitaxially grown) on a crystalline, dielectric substrate with very low loss tangents. The substrate is preferably lattice-matched. Substrate 16 should be made of low-loss materials such as magnesium oxide (MgO), lanthanum ($LaAlO_3$) or sapphire ($Al_2O_3$). Magnesium oxide is marginally acceptable. The more preferred materials are lanthanum and sapphire.

The HTSC material 18 is a material having a critical temperature greater than 25K. HTSC materials such as Y-Ba-Cu-0 and La-Ba-Cu-0 and others are suitable for layer 18. An appropriate material is $La_{2-x}Ba_xCuO_{4-y}$ or Y-Ba-Cu-O and La-Ba-Cu-O and others are suitable for cient if the wall current densities are sufficiently low. For high wall current densities, a nearly single crystal material may be used. The HTSC layer 18 may be formed on substrate 16 by techniques including sputtering deposition, vapor deposition, or laser ablation. A suitable technique for forming the elements 14 is to deposit HTSC material 18 on a heated substrate 16 by use of an off-axis epitaxial sputtering system equipped with, for example, two 2-inch magnetron sputter guns. Both guns may be used to deposit the HTSC film.

The HTSC film 18 is overlaid with a film 20 of a suitable electrically-conductive metal such as silver or gold. The metallic layer 20 may be deposited on HTSC layer 18 by the above-noted sputtering system using another magnetron sputtering gun. The HTSC film, substrate and metal overlay may be in the form of a two-inch wafer, for example, from which suitable chips or elements are cut. Such HTSC films, including the overlaid metal layer, are commercially available from Conductus, Inc., Sunnyvale, Calif.

Structure surface 12, for example the surface of an antenna or cavity, typically comprises a metal such as copper. The structure's normal metal surface 12 is coated with a metallic layer 22 which preferably comprises the same metal as metallic layer 20. However, the metal layers may be formed of different metals. Thus, layer 22, for example, may be gold or silver. Layer 22 may be coated onto surface 12 by sputtering, chemical plating or laser deposition.

The chips 14 are disposed on surface 12 by bonding layer 20 to layer 22. Preferably, as noted, layers 20 and 22 are formed of the same metal to facilitate bonding of the chips to the structure. The bonding technique may comprise thermal compression, i.e. the application of heat and pressure to join layer 20 to layer 22.

The chips 14 may be shaped to fit the metal surface to be covered. Exemplary dimensions are one inch square chips or 0.5 cm by 0.5 cm rectangular chips. The components of such chips may have the following approximate thickness dimensions: substrate =0.5 millimeters (mm), HTSC film =0.5 micron, and metal overlay =0.3 microns. The metal coating on surface 12 may be about 1 micron in thickness.

The chips 14 may cover the entire surface 12 exposed to the electromagnetic radiation. The chips are arranged on surface 12 so that a gap or space 24 between adjacent chips is as small as possible (see FIG. 1A). The cracks or gaps 24 between the chips may be filled with a material having a dielectric constant as close as possible to that of the material from which substrate 16 is formed. However, this may be unnecessary if the chips are accurately cut such that the gaps are no more than about 0.01 of an inch.

The electromagnetic radiation impinging on surface 12 faces or "sees" only the side of the structure that is coated with chips 14 (except for side edges of the structure). Thus, the electromagnetic radiation has as a boundary, substrate 16 and then HTSC film 18 backed by metallic films 20 and 22. Preferably, HTSC film 18 is thick enough that the electromagnetic field would almost be completely attenuated before reaching layer 20. As such, the thickness of film 18 should be greater than approximately $3\lambda$, where $\lambda$ is the penetration depth of the electromagnetic radiation. As noted, the electromagnetic radiation must penetrate the chip substrate material; thus, losses in the substrate will contribute to the losses of the device. However, these losses may be considered relatively small.

The plurality of chips 14 on surface 12 provides a dielectric-coated superconducting surface, except at gaps 24. The gaps, however, are effectively bridged by contiguous metallic films 20 of adjacent chips 14 and the coated metal support layer 22. As shown in FIG. 1A, the current or shunt path "A" between adjacent elements 14 is through metallic layers 20 and 22. This current path or area of surface current flow "A", however, is almost exclusively in HTSC low-loss films 18.

Assuming one-inch square chips 14 as an example, the metallic bridges 20, 22 would have a length of only about one-hundredth the length of the chip. Compared with a completely normal metallic surface, for example silver, an HTSC film 18 with a surface resistance ($R_S$) ten times lower than the silver would give about a factor of eight improvement over a silver surface, taking into account metallic bridges 20, 22. The above numbers may be somewhat conservative since the $R_S$ of the HTSC material is more than ten times better, and larger chips are becoming available.

The use of metal layer 20 on film 18 should only affect the superconductivity within a short distance from the interface between the two materials, since the coherence lengths, i.e., the minimum distance in which substantial change of the superconductive properties can be effected, in the HTSC material are only several (on the order of between 3 and 15) angstroms. It is known that the proximity-effect suppression of the energy gap in a superconductor affects only a layer of the superconductor of a thickness on the order of a coherence length. This should have only a minimum effect on the surface resistance and the losses.

The metallic layer 20 contiguous to superconductor layer 18 serves as a good heat sink as well as, as noted, a current shunt. Thus, the metallic layer may perform in much the same way as the normal metal sheath in a superconducting magnetic wire.

The mechanism of microwave magnetic flux vortex penetration into a superconducting surface, and a probable attendant increase in losses, is not yet understood sufficiently to be sure of the effect of the metallic backing layer 20. However, it is believed that this configuration should minimize the component of the magnetic field perpendicular to the HTSC film and thus raise the level of fields required for vortex penetration.

Although not shown, it is known that a suitable cryogenic refrigeration system is required. Liquid nitrogen may be employed for steady state cooling if the superconducting material selected has a transition temperature above 77K, i.e., the temperature at which liquid nitrogen boils. Y-Ba-Cu-O materials have transition temperatures above 77K. The advantage of cooling at this temperature is that large amounts of heat can be removed by the liquid nitrogen at relatively high efficiencies, and it is very inexpensive. Other cooling fluids such as Ne, H, and He may be used if better superconducting properties are required by means of lower temperature operation. Cooling efficiency would, however, be decreased. Cooling can also be achieved by using $N_2$, Ne, H, or He supercooled gas, for example, contained in a dewar.

Normally, an antenna, such as a reflector antenna, has a dimension of one-half wavelength or longer, and the antenna losses are not important. However, if the antenna is much smaller than one-half wavelength, it becomes a very inefficient radiator. The copper losses can often be ten or even a hundred times that of the radiation power. Through a matching network, large currents may be supplied to a small antenna, but only a small part of the energy can be delivered to radiation. The use of HTSC materials can significantly increase the efficiencies of such antennas, for example, dipole, monopole and loop antennas.

Figure 2:
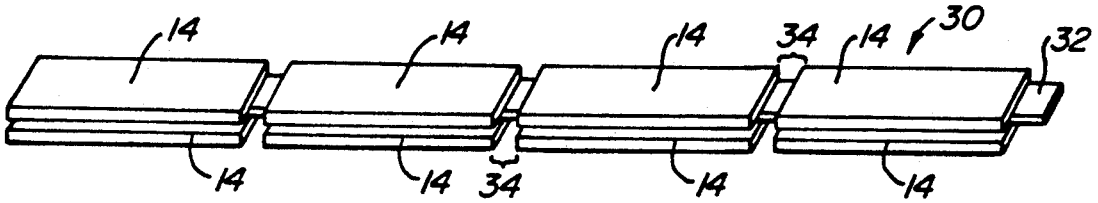
FIG. 2 is a schematic view of a dipole antenna in accordance with the present invention.

As shown in FIG. 2, a dipole antenna 30 could be made with a thin metal strip 32, such as copper or brass coated with silver. Metal strips 32 would not only form the antenna but also its feed and matching structure. The metal strip 32 would be covered on both sides with chips 14. Preferably, metal strip 32 is as wide as each chip 14. As discussed, chips 14 include substrate 16, HTSC film 18, and a suitable metallic layer 20. Also as discussed above, the chips are attached (bonded) with HTSC film 18 facing inward toward strip 32 so that the conducting electromagnetic boundary is the HTSC film. The surface currents flow almost exclusively in the HTSC films. The spaces or gaps 34 between chips 14 are greatly exaggerated in FIG. 2. They, however, may be filled with a suitable dielectric material.

Patch antennas have become very popular in recent years because of their low cost. Actually patch antennas are a class of small antennas since they are usually small compared to one-half wavelength. A patch antenna is usually loaded with dielectric material so that it resonates before the exterior dimension is comparable to one-half wavelength. As a result, patch antennas are narrow band and lossy. Therefore, HTSC materials can be used advantageously in patch antennas to improve radiation efficiency.

Curved antenna surfaces could be approximated by a multiplicity of flat surfaces and by appropriately shaping the chips.

A cavity or cavity resonator filled with air has a higher quality Q factor than thin-film or bulk dielectric cavities because of the losses in the dielectric material and because the volume to surface ratio can be larger.

For example, a cubic resonant cavity would have inside dimensions of about 2.12 cm for a 10 GHz resonant frequency. If a layer of dielectric material is coated on the inside of the cavity, the resonant frequency would be somewhat lower.

Figure 3:
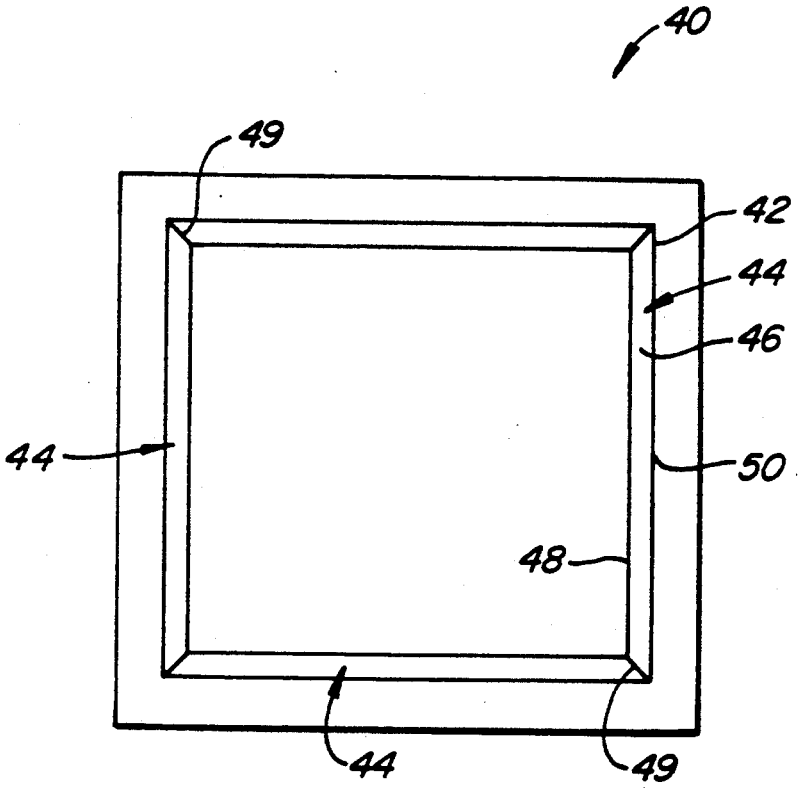
FIG. 3 is a cross-sectional schematic view of a microwave cavity in accordance with the present invention.

As shown in FIG. 3, a microwave cavity 40 may be fabricated such that its inside surfaces 42 are covered by HTSC chips 44. As discussed above, the chips or elements 44 include a film or layer 46 of HTSC material formed on a substrate 48. The chips 42 also include a metal film or layer 50 disposed on film 46. The chips 42 have the appropriate size to cover the inside surface of the cavity. They are bonded to interior cavity walls 42 with the metal bilayer 50 in contact with, for example, the metal coated (e.g., silver or gold) walls of the cavity. As in the case of the antennas, the electromagnetic field "sees" the superconductor rather than the normal metal walls of the cavity, except at corner joints 49 of the cavity. The result should be a very high Q cavity if the losses in the dielectric substrates are not too high. A sapphire substrate, for example, would contribute little to the cavity losses. The permitted power levels should also be higher than for other resonators since the metal backing will minimize penetration of magnetic vortices into the film.

The techniques described above for cavities and antennas may also be applied to HTSC transmission lines and other microwave and millimeter-wave components. As discussed, such structures should be able to accommodate higher power levels, and provide improved cooling capability and reduced magnetic vortex penetration. These feature may make higher fields possible and thus enhance the feasibility of transmitter devices using HTS films.

The present invention uses multiple chips in a single structure. The substrate side of the chips is exposed to the electromagnetic fields, rather than the HTSC film side. The chips include an advantageous metal backing layer on the HTSC film. Since there are microwave or millimeter-wave losses anyway in a superconducting film, the need to provide normal metal links can be a quantitatively acceptable penalty to pay for the use of the high quality HTSC films.

The present invention has been described in terms of a preferred embodiment. The invention, however, is not limited to the embodiment depicted and described. Rather, the scope of the invention is defined by the appended claims.

What is claimed is:

1. A structure exposed to electromagnetic radiation, comprising: a surface and a plurality of discrete elements, a portion of the surface being substantially covered with said elements, each element including an insulating substrate having a face substantially covered by a superconducting material having a critical temperature greater than 25K, said substrate of each element facing the electromagnetic radiation and said superconducting material of each element facing the surface to be in electrical contact therewith, and a means for electrically connecting each said element.

2. The structure of claim 1 wherein the surface comprises a plurality of flat surfaces defining a resonant cavity with said elements covering said flat surfaces.

3. The structure of claim 1 wherein the surface comprises a flat surface defining an antenna with said elements covering said flat surface.

4. The structure of claim 1 further including a fluid in direct contact with said elements to cool the superconducting material.

5. The structure of claim 1 wherein said superconducting material is La-Ba-Cu-O.

6. The structure of claim 1 wherein said superconducting material is Y-Ba-Cu-O.

7. The structure of claim 1 wherein said superconducting material comprises a thin layer on each corresponding substrate, each said layer having a thickness, and the thickness of said superconducting layer is greater than about three times a penetration depth of the electromagnetic radiation.

8. A structure exposed to electromagnetic radiation, comprising: a metal surface and a plurality of discrete elements, each element including an insulating substrate and a high-temperature superconducting material substantially covering a face of said substrate, a portion of said metal surface being substantially covered with said elements with said superconducting material thereof adjacent to and in electrical contact with said metal surface, thereby reducing ohmic losses on exposure of said structure to said electromagnetic radiation.

9. A structure having low ohmic losses upon interaction with electromagnetic radiation in the microwave or millimeter-wave spectrum, comprising: a plurality of elements disposed on at least a portion of a surface of the structure, said plurality of elements configured to define neighboring elements, each element including an insulating substrate and a superconducting material having a critical temperature greater than 25K substantially covering a face of the substrate, said elements disposed on the surface of the structure such that the substrates thereof are exposed to the radiation and the superconducting material thereof faces the surface of the structure; and means for providing a conductive path between said neighboring elements disposed on the surface of the structure.

10. The structure of claim 9 wherein said conductive path means includes a metallic surface disposed between the superconducting material of said neighboring elements and the surface of the structure.

11. The structure of claim 10 wherein said metallic surface includes two discrete metal layers to define a metal link between said neighboring elements, each one of said two metal layers consisting of the same type of metal.

12. The structure of claim 10 wherein the surface of said structure is a first metal and said metallic surface includes a second metal different from said first metal.

13. The structure of claim 12 wherein said first metal is copper and said second metal is selected from the group consisting of silver and gold.

14. A structure having low ohmic losses upon interaction with electromagnetic radiation in the microwave or millimeter-wave spectrum, comprising: a plurality of elements, each element including an insulating substrate having a film of high temperature superconducting material substantially covering a face of said substrate and an electrically conductive first metal layer disposed on a side of said film opposite said substrate; and said elements disposed on a surface of the structure such that said substrates thereof are exposed to the radiation and the metal layers thereof are adjacent the surface of the structure to provide for electrical connection between said elements.

15. The structure of claim 14 wherein said structure is elongated and the surface comprises a metal strip to define a dipole antenna, said elements covering the metal strip.

16. The structure of claim 4 further including a second metal layer disposed between and adjacent to said first metal layer and the surface of the structure.

17. The structure of claim 16 wherein the surface comprises a plurality of flat surfaces defining a resonant cavity and said elements cover said flat surfaces.

18. The structure of claim 14 wherein said surface of said structure comprises a flat surface defining an antenna and said elements cover said flat surface.

19. The structure of claim 14 wherein said superconducting material film on each said substrate has a thickness, and the thickness of said film is greater than about three times a penetration depth of the radiation in said film.

20. A structure having low ohmic losses upon interaction with electromagnetic radiation in the microwave or millimeter-wave spectrum comprising: a plurality of discrete elements, each element including a high-temperature superconducting film substantially covering a face of a corresponding insulating substrate, said plurality of elements disposed on a surface of the structure in an abutting relationship therewith such that the substrates face away from the surface, said plurality of elements configured to define neighboring elements; and means for electrically connecting said neighboring elements.

21. The structure of claim 20 wherein said electrically connecting means includes a metal layer on the surface of the structure.

22. The structure of claim 20 wherein each substrate has a dielectric constant and gaps exist between neighboring elements, the gaps containing a dielectric material having substantially the same dielectric constant as the substrates.

23. The structure of claim 20 wherein each one of the superconducting films has edges and the superconducting films are electrically interconnected along the edges thereof by said electrically connecting means.

* * * * *

UNITED STATES PATENT AND TRADEMARK OFFICE

CERTIFICATE OF CORRECTION

PATENT NO. : 5,215,959

DATED : June 1, 1993

INVENTOR(S) : Theodore Van Duzer

It is certified that error appears in the above-indentified patent and that said Letters Patent is hereby corrected as shown below:

In the Drawings:

Drawing sheet 1, Fig. 1A, the extremities of arrow A should not extend into chip substrates 16. Arrow A should start and end in superconducting films 18.

Signed and Sealed this

Seventeenth Day of May, 1994

Bruce Lehman

*Attest:*

BRUCE LEHMAN

*Attesting Officer*

*Commissioner of Patents and Trademarks*